US007107990B2

(12) United States Patent
Lee

(10) Patent No.: US 7,107,990 B2
(45) Date of Patent: Sep. 19, 2006

(54) PORTABLE FACE PROTECTOR FOR PROTECTING HUMAN BEING FROM POISONOUS GAS AND SECURING VISIBILITY

(76) Inventor: Kuk-Bin Lee, 123-1102 Parktown, 54 Sunae-dong, Bundang-gu, Gyonggi-do, Seongnam-City (KR) 463-020

( * ) Notice: Subject to any disclaimer, the term of this patent is extended or adjusted under 35 U.S.C. 154(b) by 0 days.

(21) Appl. No.: 10/928,189

(22) Filed: Aug. 30, 2004

(65) Prior Publication Data

US 2006/0042628 A1 Mar. 2, 2006

(51) Int. Cl.
*A62B 18/02* (2006.01)

(52) U.S. Cl. ..... 128/205.25; 128/206.12; 128/206.14; 128/206.25; 128/206.27; 128/206.28; 128/206.24; 128/206.23; 128/206.19; 128/205.28; 128/205.29

(58) Field of Classification Search ..... 128/206.12, 128/206.14, 206.25, 206.27, 206.28, 206.24, 128/206.23, 206.19, 205.28, 205.29
See application file for complete search history.

(56) References Cited

U.S. PATENT DOCUMENTS 4,032,991 A * 7/1977 Vandeweghe ..... 128/201.25
4,122,847 A * 10/1978 Craig ..... 128/858
4,382,440 A * 5/1983 Kapp et al. ..... 128/201.25
4,726,365 A * 2/1988 Jablonski ..... 128/202.13
4,856,509 A * 8/1989 Lemelson ..... 128/206.19
D319,111 S * 8/1991 Sandel et al. ..... D24/110.2
5,383,450 A * 1/1995 Hubbard et al. ..... 128/206.23
5,406,943 A * 4/1995 Hubbard et al. ..... 128/206.12
5,655,525 A * 8/1997 Orr ..... 128/205.25
5,704,063 A * 1/1998 Tilden ..... 2/9
5,704,349 A * 1/1998 Hubbard et al. ..... 128/206.19
5,797,146 A * 8/1998 Matich ..... 2/424
6,308,330 B1 * 10/2001 Hollander et al. ..... 2/9
6,453,902 B1 * 9/2002 Hollander et al. ..... 128/201.17
6,526,975 B1 * 3/2003 Chung ..... 128/206.14
6,609,516 B1 * 8/2003 Hollander et al. ..... 128/201.17
6,984,037 B1 * 1/2006 Bleau ..... 351/83

* cited by examiner

*Primary Examiner*—Henry Bennett
*Assistant Examiner*—Nihir Patel
(74) *Attorney, Agent, or Firm*—Rosenberg, Klein & Lee

(57) ABSTRACT

Disclosed is a portable face protector for protecting a human being from poisonous gas and securing visibility, which can be used in an emergency such as a fire, etc. The face protector comprises a visibility securing member having a transparent window, for tightly covering a face around eyes of a user; and a cloth member for tightly covering the face around a mouth and a nose of the user so as to filter poisonous gas in an emergency. Therefore, the face protector can be facilely carried and rapidly used in an emergency such as a fire, etc., so as to protect a human lift from the poisonous gas and safely escape from a critical region.

13 Claims, 12 Drawing Sheets

KOREA INSTITUTE OF CONSTRUCTION TECHNOLOGY
KICT
2311, Daehwa-dong, Ilsan-gu, Koyang-shi, Kyunggi-do 411-712, Korea
•Tel:82-31-9100-114 •Fax:82-31-9100-441

Test Certificate

1. Certificate No. : 0406-1140
2. Applicant
   - Name : ChemKorea
   - Address : 3F, 628-6, Deungchon-dong, Kangseo-Ku Seoul Korea
   - Date of Receipt : Jun. 7th. 2004
   - Receipt No. : 716
3. Purpose of Test Certificate : Gas Analysis Test
4. Name of Specimen : Moist Cotten Mask (size :13cm x 9.5cm)
5. Tested Date : Jun. 9th, 11th 2004
6. Test Standard : Method by client
7. Test Result (Refer to attachment)

Tested by: n.w.cho
Cho, nam-wook
Researcher

Approved by: Byungyeol Min
Min, byung-yeol
Technical Manager

Above is the test result of specimen(frame) supplied by client, and the name of specimen belongs to client.

Jun 22th. 2004

The President of Korea Institute of Construction Technology

This certificate may not be used besides purpose, and an unapproved copy is prohibited (Page No. 1 of total 9 pages)

<F-QP-05-11-2/2> 2004-716 KICT

FIG.8

Certificate No: C406-1140

1. Tested Date : Jun. 9th, 11th 2004

2. Name of Specimen : Moist Cotten Mask (size :13cm x 9.5cm)

3. Test Method

1) Based on ASTM D 6348, Test was conducted.

2) Filter element were placed in filter holder in chamber as this picture,

3) Standard gas & sample holder are supplied by client

- $SO_2$ 197.2 ppm
- Sample Holder (with 50L/Min Flowmeter)

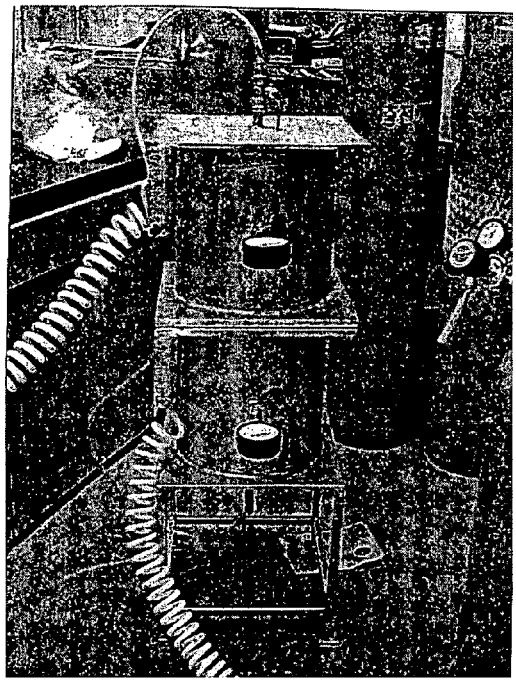

4. FT-IR Conditioning

1) Gas call Path Length : 10 m

2) Light Source : Infrared

3) Measurement Mode : Absorbance

4) Resolution : 0.5

5) No. of scans : 1

(Page No. 2 of total 9 pages)

<F-QP-05-11-2/2> 2004-716 KICT

FIG.9

Certificate No: 0406-1144

5. TEST Result

1) Time-Concentration Table ($SO_2$ -1)

| Specimen | Test Gas | STANDARD GAS CONC. (ppm) | FLOW (L/min) Before the filter | FLOW (L/min) After the filter | Time- Concentration(sec.ppm) | | | | | | | |
|---|---|---|---|---|---|---|---|---|---|---|---|---|
| Mask (1) | $SO_2$ | 197.2 | 10 | 9 | sec | 26 | 53 | 78 | 104 | 130 | 153 | 183 |
| | | | | | ppm | 0 | 0 | 0 | 0 | 0 | 0 | 0 |
| | | | | | sec | 209 | 234 | 260 | 286 | 312 | 338 | 364 |
| | | | | | ppm | 0 | 0 | 0 | 0 | 0 | 26 | 39 |
| | | | | | sec | 416 | 442 | 468 | 494 | - | - | - |
| | | | | | ppm | 67 | 85 | 99 | 107 | - | - | |

2) Graph ($SO_2$ -1)

(Page No. 3 of total 5 pages)

Certificate No: 0406-1144

3) Time-Concentration Table($SO_2$ -2)

| Specimen | Test Gas | STANDARD GAS CONC. (ppm) | FLOW (L/min) Before the filter | FLOW (L/min) After the filter | Time- Concentration(sec.ppm) | | | | | | | |
|---|---|---|---|---|---|---|---|---|---|---|---|---|
| Mask (2) | $SO_2$ | 197.2 | 10 | 9 | sec | 23 | 49 | 81 | 106 | 131 | 156 | 182 |
| | | | | | ppm | 0 | 0 | 0 | 0 | 0 | 0 | 0 |
| | | | | | sec | 208 | 235 | 261 | 287 | 314 | 340 | 365 |
| | | | | | ppm | 0 | 0 | 6 | 11 | 35 | 60 | 73 |
| | | | | | sec | 390 | 416 | 441 | 467 | 492 | - | - |
| | | | | | ppm | 74 | 99 | 107 | 113 | 111 | - | |

4) Graph ($SO_2$ -2)

(Page No. 4 of total 5 pages)

Certificate No: 0406-1144

5) Time-Concentration Table(HCl)

| Specimen | Test Gas | STANDARD GAS CONC. (ppm) | FLOW (L/min) Before the filter | FLOW (L/min) After the filter | Time- Concentration(sec.ppm) | | | | | | | | | |
|---|---|---|---|---|---|---|---|---|---|---|---|---|---|---|
| Mask (3) | HCl | 982 | 10 | 9 | sec | 23 | 46 | 73 | 98 | 124 | 150 | 176 | 202 | 229 |
| | | | | | ppm | 0 | 0 | 0 | 0 | 0 | 0 | 0 | 0 | 0 |
| | | | | | sec | 254 | 280 | 305 | 332 | 657 | 388 | 414 | 440 | 466 |
| | | | | | ppm | 0 | 0 | 0 | 0 | 0 | 0 | 0 | 0 | 0 |
| | | | | | sec | 493 | 519 | 546 | 574 | 600 | 628 | 653 | 680 | 706 |
| | | | | | ppm | 0 | 0 | 0 | 0 | 0 | 0 | 0 | 0 | 0 |
| | | | | | sec | 732 | 759 | 785 | 812 | 839 | 868 | 893 | 922 | 929 |
| | | | | | ppm | 0 | 0 | 0 | 0 | 0 | 0 | 0 | 0 | 0 |
| | | | | | sec | 976 | 1004 | 1030 | 1059 | 1082 | 1110 | 1136 | 1161 | 1942 |
| | | | | | ppm | 0 | 0 | 0 | 0 | 0 | 0 | 0 | 0 | 0 |
| | | | | | sec | 2015 | - | - | - | - | - | - | - | - |
| | | | | | ppm | 0 | - | - | - | - | - | - | - | - |

(Page No. 5 of total 5 pages)

FIG.12

Certificate No: 0406-1140

11) Time-Concentration Table (HCl -1)

| Specimen | Test Gas | STANDARD GAS CONC. (ppm) | FLOW (L/min) Before the filter | FLOW (L/min) After the filter | Time- Concentration(sec.ppm) | | | | | | |
|---|---|---|---|---|---|---|---|---|---|---|---|
| Mask (5) | HCl | 982 | 10 | 10 | sec | 24 | 50 | 75 | 101 | 128 | 153 |
| | | | | | ppm | 0 | 0 | 0 | 0 | 0 | 0 |
| | | | | | sec | 179 | 205 | 231 | 256 | 281 | 307 |
| | | | | | ppm | 0 | 0 | 0 | 0 | 0 | 0 |

12) Time-Concentration Table (HCl -2)

| Specimen | Test Gas | STANDARD GAS CONC. (ppm) | FLOW (L/min) Before the filter | FLOW (L/min) After the filter | Time- Concentration(sec.ppm) | | | | | | |
|---|---|---|---|---|---|---|---|---|---|---|---|
| Mask (6) | HCl | 982 | 10 | 10 | sec | 24 | 54 | 79 | 104 | 130 | 156 |
| | | | | | ppm | 0 | 0 | 0 | 0 | 0 | 0 |
| | | | | | sec | 183 | 209 | 235 | 260 | 287 | 314 |
| | | | | | ppm | 0 | 0 | 0 | 0 | 0 | 0 |

13) Time-Concentration Table (HCl -3)

| Specimen | Test Gas | STANDARD GAS CONC. (ppm) | FLOW (L/min) Before the filter | FLOW (L/min) After the filter | Time- Concentration(sec.ppm) | | | | | | |
|---|---|---|---|---|---|---|---|---|---|---|---|
| Mask (7) | HCl | 982 | 10 | 10 | sec | 26 | 52 | 79 | 104 | 129 | 155 |
| | | | | | ppm | 0 | 0 | 0 | 0 | 0 | 0 |
| | | | | | sec | 181 | 207 | 232 | 261 | 288 | 314 |
| | | | | | ppm | 0 | 0 | 0 | 0 | 0 | 0 |

(Page No. 8 of total 9 pages)

FIG.13

PORTABLE FACE PROTECTOR FOR PROTECTING HUMAN BEING FROM POISONOUS GAS AND SECURING VISIBILITY

BACKGROUND OF THE INVENTION

1. Field of the Invention

The present invention relates to a portable face protector for protecting a human being from poisonous gas and securing visibility, which can be used in an emergency such as a fire, etc.

2. Description of the Related Art

Generally, a gas mask is to protect a human life from a poisonous gas generated when a fire breaks out or a biochemical gas is spread in war or terrorism. The gas mask purifies the poisonous gas so that a human being can breathe.

Recently, due to frequent fires in a department store, a hotel, a theater, a transportation such as a bus, a subway, etc., the gas mask has attracted a lot of attention. Since a user can quickly wear the gas mask in an emergency such as a fire, etc., the gas mask is tending to have a simple structure. Thus, the gas mask can be used for only a desired time the user can escape from a critical region.

Meanwhile, since a conventional gas mask is considerably large and heavy and it is thus inconvenient for a general person to carry the gas mask, there is a problem that it is hard to facilely get the gas mask in the emergency. Furthermore, even if it is possible to get the gas mask in the emergency, there is another problem that it is hard for the general person, who is not trained, to rapidly wear the gas mask in the emergency. Therefore, it is urgently required to develop a gas mask that the general person can easily use and also facilely carry.

In addition, since the conventional gas mask is sold at a high price, it is too much for the government or a local autonomous entity to place a large quantity of gas masks in many public areas. Further, it will be also an economical burden on the general persons to individually buy the gas mask.

SUMMARY OF THE INVENTION

An object of the present invention is to provide a portable face protector for protecting a human being from poisonous gas and securing visibility, which can be facilely carried and rapidly used in an emergency such as a fire, etc., so as to protect a human lift from the poisonous gas and safely escape from a critical region, and which can be also sold at a low price.

To achieve these and other advantages and in accordance with the purpose of the present invention, a portable face protector comprises a visibility securing member having a transparent window, for tightly covering a face around eyes of a user; and a cloth member for tightly covering the face around a mouth and a nose of the user so as to filter poisonous gas, wherein, in an emergency, the visibility securing member is air-tightly attached to the face around eyes so as to secure visibility of the user through the transparent window, and the cloth member is hold by a hand of the user so as to tightly cover the face around the mouth and nose, whereby the user can be protected from the poisonous gas and can safely escape from a critical region.

Preferably, the visibility securing member has an attaching portion so as to be tightly attached to the face, and the attaching portion of the visibility securing member has an adhesive surface that is covered with a protecting paper to prevent the adhesive surface from being exposed to an outside.

Preferably, the protecting paper has a separating portion at a side thereof so as to be facilely separated from the adhesive surface of the attaching portion.

Preferably, the cloth member is formed of antibiotic cotton paper or a fabric material.

Preferably, the cloth member is vacuously packed in a state of being wet with a solution for filtering the poisonous gas.

Preferably, the solution is a saline solution or purified water.

Preferably, the cloth member has an active carbon portion for filter the poisonous gas.

Preferably, the face protector further comprises a first receiving portion for vacuously packing the visibility securing portion, and a second receiving portion for vacuously packing the cloth member.

Preferably, the first and second receiving portions are formed of vinyl or aluminum foil.

Preferably, the first and second receiving portions are respectively formed with a detaching groove at a side thereof so as to rapidly and easily rip one side of each of the first and second receiving portions open and then withdraw the visibility securing member and the cloth member.

BRIEF DESCRIPTION OF THE DRAWINGS

The above aspects and features of the present invention will be more apparent by describing certain embodiments of the present invention with reference to the accompanying drawings, in which:

FIGS. 8 to 13 are experimental data showing a performance of the cloth member of the portable face protector according to the present invention.

DETAILED DESCRIPTION OF THE PREFERRED EMBODIMENTS

Reference will now be made in detail to the preferred embodiments of the present invention, examples of which are illustrated in the accompanying drawings.

A portable face protector of the present invention is to protect a human being from poisonous gas and secure visibility, and comprises a first receiving portion and a second receiving portion 20, as shown in FIGS. 1 to 5.

Figure 1:
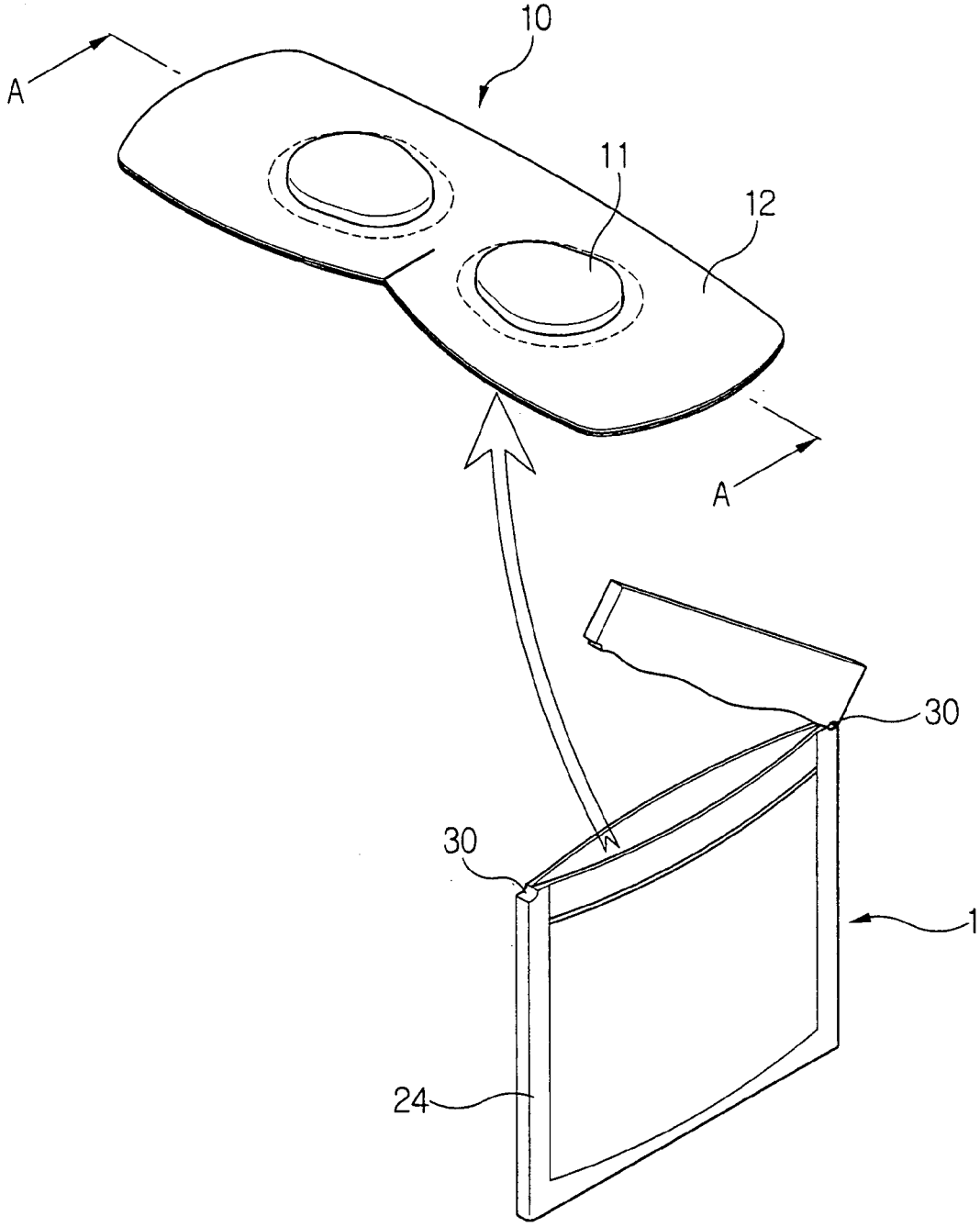
FIG. 1 is a perspective view of a first receiving portion and a visibility securing member of a portable face protector according to the present invention.

As shown in FIG. 1, the first receiving portion 1 receives a visibility securing member 10 therein.

In order to minimize an entire volume of the first receiving portion 1, the visibility securing member 10 is folded a few times and then received in the first receiving portion 1. Therefore, a user can conveniently carry the first receiving portion 1 in a small bag, a hand bag and a pocket.

The first receiving portion 1 is formed of vinyl and aluminum foil. The visibility securing member 10 can be withdrawn from the first receiving portion 1 after ripping a side of the first receiving portion 1 open using a detaching groove 30.

The detaching groove 30 is formed at each end of both opposite sides of the first receiving portion 1. Therefore, in an emergency, the user can easily rip one side of the vinyl or aluminum foil of the first receiving portion 1 and then withdraw the visibility securing member 10.

Figure 2:
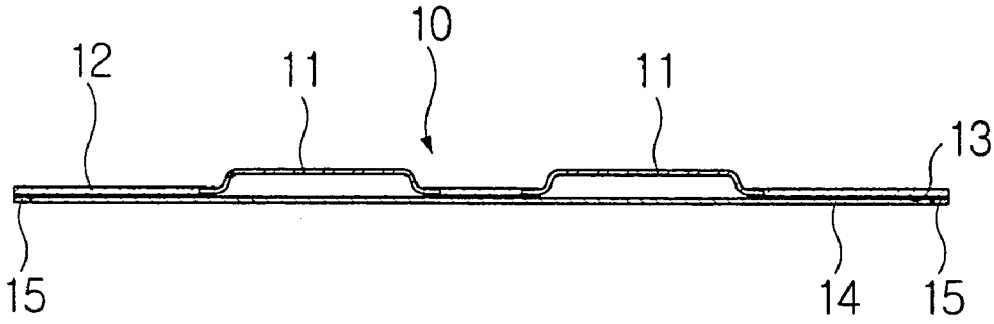
FIG. 2 is a cross-sectional view taken along a line A—A of FIG. 1.
Figure 3:
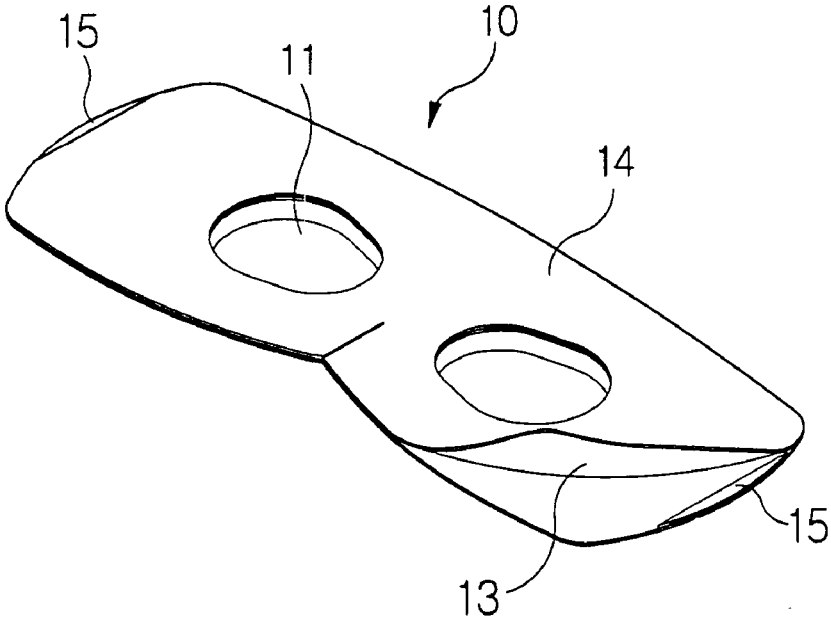
FIG. 3 is a lower perspective view of the visibility securing member of the visibility securing member of the portable face protector according to the present invention.

As shown in FIGS. 1 to 3, the visibility securing member 10 comprises a pair of transparent windows 11 and an attaching portion 12 formed around each of the transparent windows 11 so as to be attached to a face.

The transparent windows 11 are symmetrically disposed at both sides of the visibility securing member 10, and have an elliptical shape. Besides, the transparent windows 11 may have various shapes. For example, the transparent window may be formed into a single large window shape.

Further, the transparent windows 11 are convexed toward each from face thereof so as to form a concaved space therein.

The transparent window 11 may be formed of glass or synthetic resin like plastic. In case of the plastic, it is preferred that it has a high heat resistance which is higher than a temperature that a general person can endure.

Meanwhile, the shape of the transparent window 11 is not limited to a block structure as shown in FIGS. 1 to 3. The transparent window 11 may be formed to be planed or convexed at only a blade portion of a nose.

Preferably, the attaching portion 12 of the visibility securing member 10 is formed of cotton or non-woven fabric, and may be formed of paper, vinyl, plastic, silicon, etc., which can be excellently attached to the face.

One surface of the attaching portion 12 is an adhesive surface 13.

The attaching portion 12 has a size that can cover the cheekbone and the blade portion of the nose from a forehead or glabella of the face.

A protecting paper 14 is covered on the adhesive surface 13 of the attaching portion 12 to prevent the adhesive surface 13 from being exposed to the outside.

The protecting paper 14 has a separating portion 15 at a side thereof so as to be facilely separated from the adhesive surface 13 of the attaching portion 12.

That is, in the emergency, a user rapidly peels off the protecting paper 14 from the attaching portion 12 using the separating portion 15.

The visibility securing member 10 is standardized into a small size, a middle size and a large size, so that the user can choose a proper size of the visibility securing member 10 according to a size of the user's face.

Figure 4:
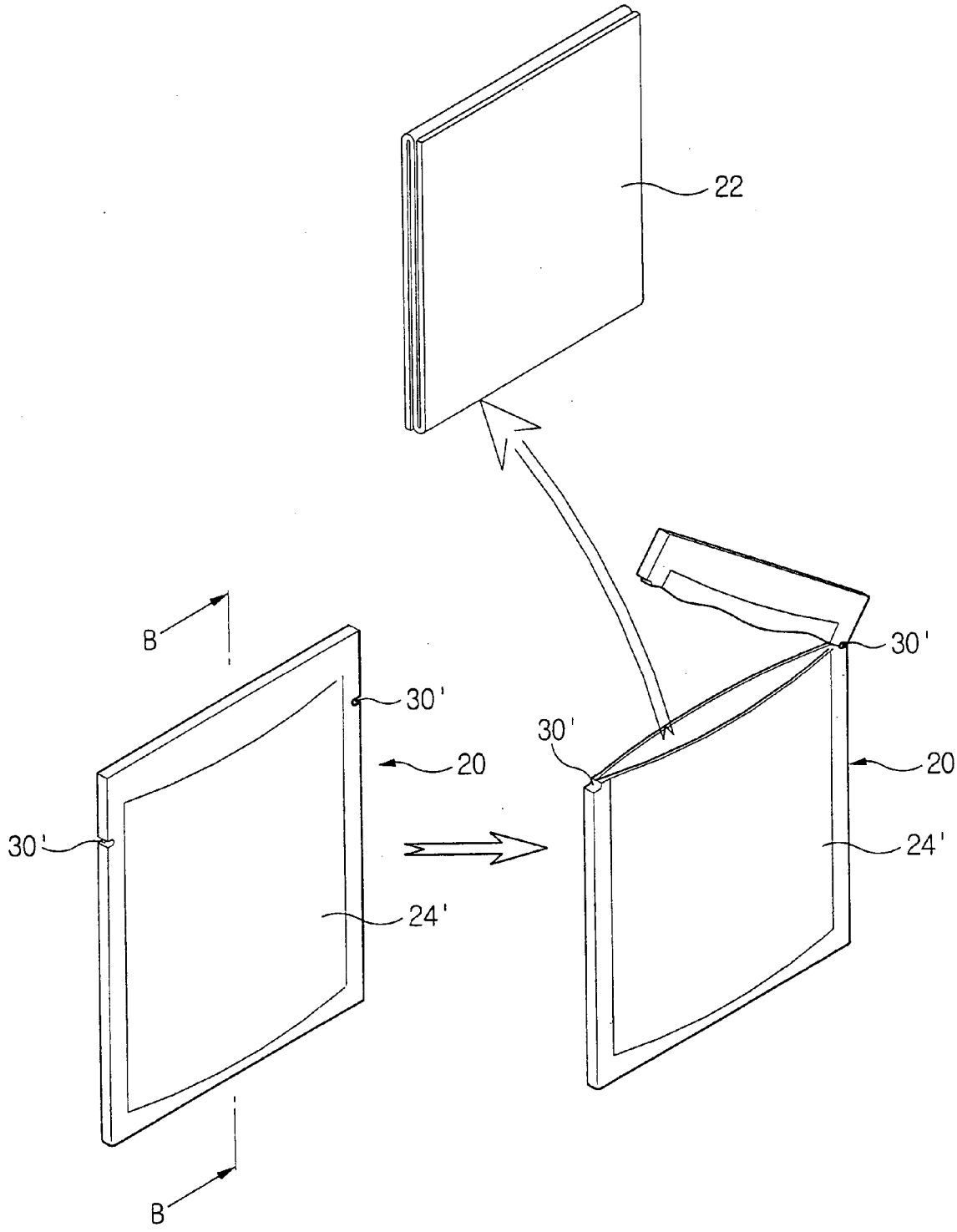
FIG. 4 is a perspective view of a second receiving portion and a cloth member of the portable face protector according to the present invention.
Figure 4A:
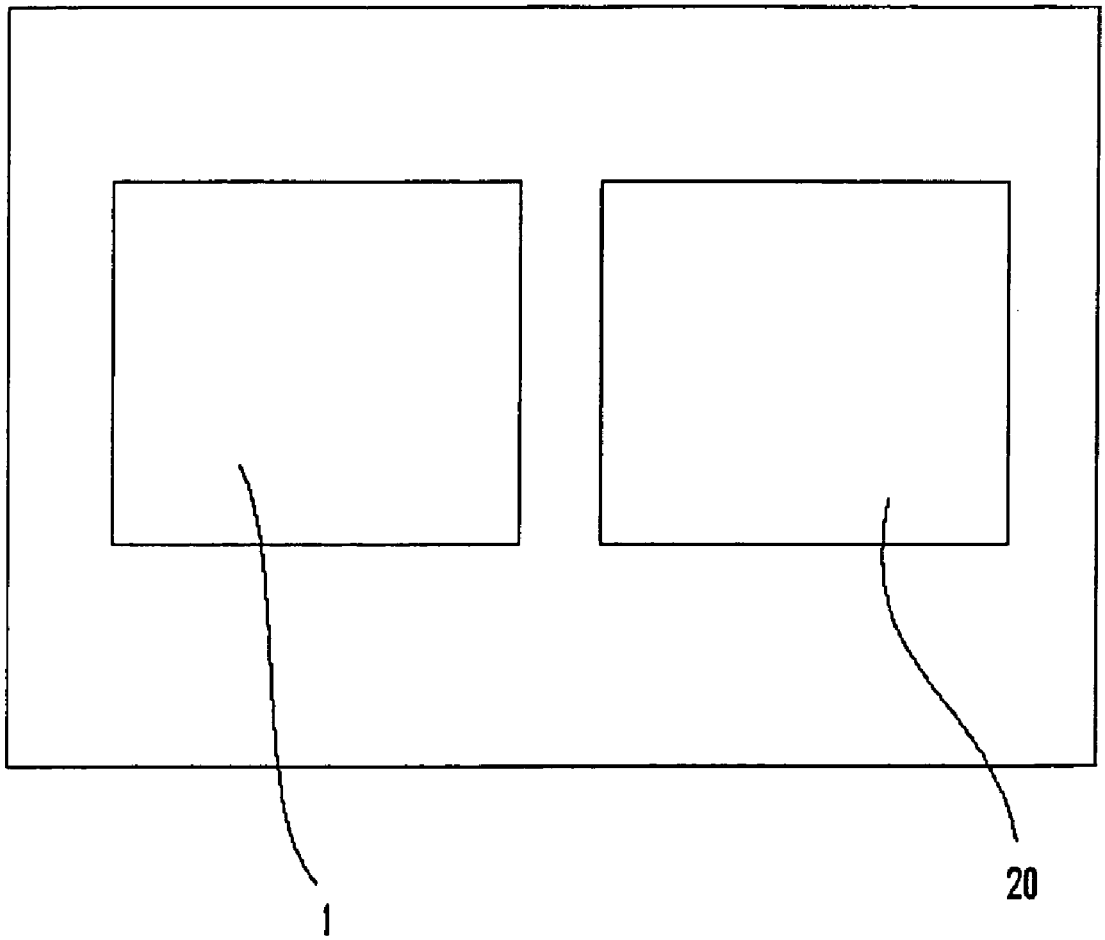
FIG. 4A is a schematic view illustrating the combination of first and second portions of the present invention.
Figure 5:
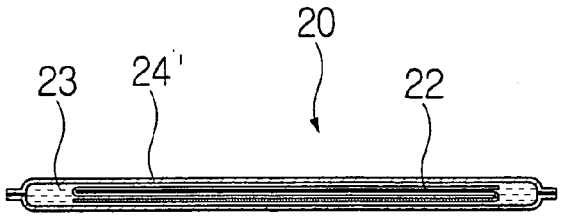
FIG. 5 is a cross-sectional view taken along a line B—B of FIG. 4.

Meanwhile, as shown in FIGS. 4 and 5, the second receiving portion 20 receives a cloth member 22 therein.

In order to minimize an entire volume of the second receiving portion 20, the cloth member 22 is folded a few times and then received in the second receiving portion 20.

This is for the user to conveniently carry the second receiving portion 20 in the small bag, the hand bag and the pocket, like the first receiving portion 1.

Preferably, the cloth member 22 is formed of antibiotic cotton paper. Furthermore, the cloth member 22 may be formed of other fabric material besides the antibiotic cotton paper.

The second receiving portion 20 is formed of the vinyl or aluminum foil 24'. Preferably, the cloth member 22 is vacuously packed in the vinyl or the aluminum foil 24' in a state of being wet with a saline solution 23.

The cloth member 22 can be withdrawn from the second receiving portion 20 after ripping a side of the second receiving portion 20 open using a detaching groove 30'. The detaching groove 30' is formed at both opposite sides of the second receiving portion 20. Therefore, in an emergency such as a fire, etc., the user can easily rip one side of the vinyl or aluminum foil 24' of the second receiving portion 20 and then withdraw the cloth member 22.

As shown in FIGS. 4 and 5, the cloth member 22 is formed into a rectangular cotton handkerchief type, and may be a cotton grove type in which the user's fingers can be inserted, or a general mask type. In addition, it may be formed into a mouthpiece type in which the cloth member 22 that is wet with the saline solution is put in a plastic container, etc.

The reason why the cloth member 22 is kept in the second receiving portion 20 in the state of being wet with the saline solution 23 is to prevent an inflow of the poisonous gas when the user breathes in the emergency situation and thus to prevent a difficulty in breathing and also to prevent a deterioration of the cloth member 22 when the cloth member 22 is taken in custody for a long time.

However, the saline solution 23 can be substituted wit purified water or other solution which can effectively prevent the poisonous gas.

In addition, the cloth member 22 may have an active carbon portion (not shown) for filter the poisonous gas.

The cloth member 22 of the second receiving portion 20 is standardized into a small size, a middle size and a large size, so that the user can choose a proper size of the cloth member 22 according to a size of the user's face, i.e., a size of the user's nose and mouth.

FIGS. 1 to 7 show a status that the face protector of the present invention is used.

If the poisonous gas is generated due to a fire, etc., the user rapidly rips the side of the vinyl or the aluminum foil 24 of the first receiving portion 1 open using the detaching groove 30, and then withdraws the visibility securing member 10 from the first receiving portion 1.

Figure 6:
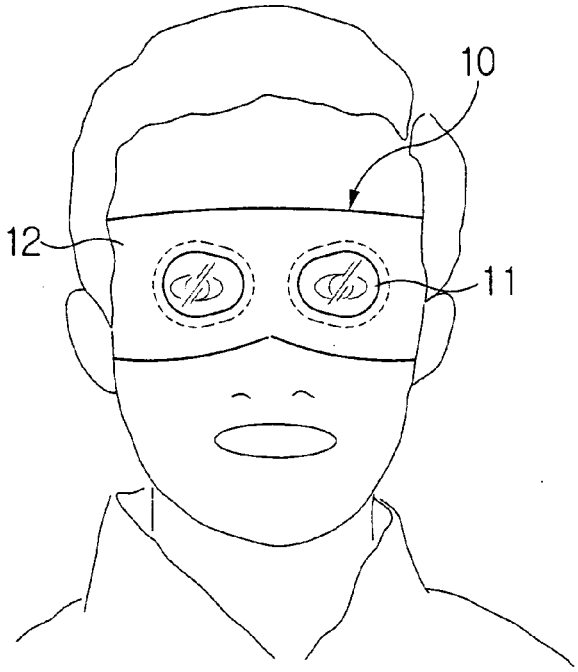
FIG. 6 is a front view showing a status that a user wears the visibility securing member of the portable face protector according to the present invention.

Then, the user rapidly peels off the protecting paper 14 from the attaching portion 12 using the separating portion 15, and then air-tightly covers his/her face around eyes with the visibility securing member 10 using the adhesive surface 13 of the attaching portion 12, as shown in FIG. 6.

Meanwhile, the cloth member 22 can be also withdrawn from the second receiving portion 20 after ripping the side of the vinyl or the aluminum foil 24' open using the detaching groove 30'.

Figure 7:
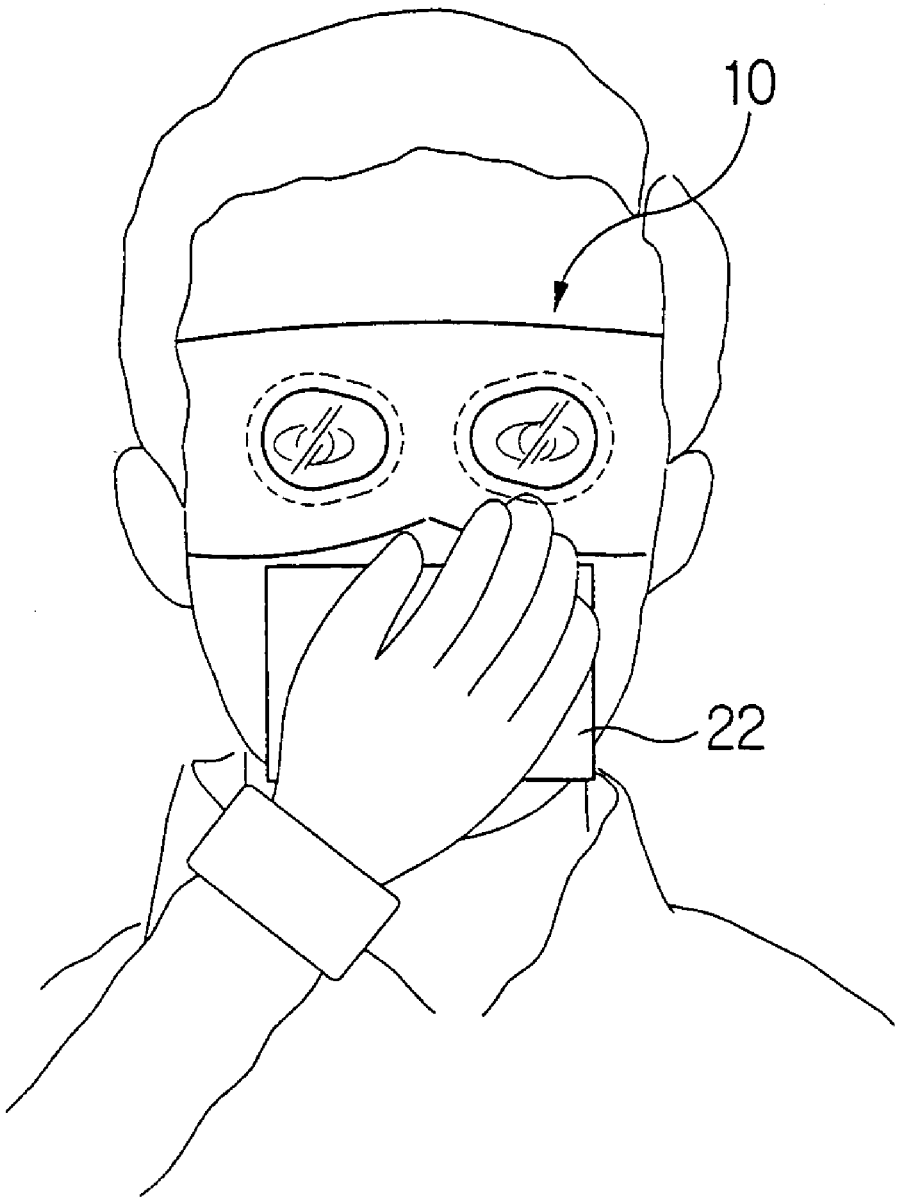
FIG. 7 is a front view showing a status that the user uses the cloth member after wearing the visibility securing member of the portable face protector according to the present invention.

At this time, if the withdrawn cloth member 22 is the cotton handkerchief type, as shown in FIG. 7, the user takes hold of the cotton handkerchief and covers his/her own mouth and nose with the cotton handkerchief so as to prevent the poisonous gas from being come into his/her respiratory organ.

Although not shown in drawings, if the withdrawn cloth member 22 is the general mask, the user wears the mask on his/her ears using a string of the mask so as to protect the human being from the poisonous gas.

As described above, the face protector of the present invention is formed into a one-time product, so that the user can quickly escape from the critical region in a state that the face protector protects the user's eyes, noise and mouth, etc., from the poisonous gas generated in a fire. Particularly, when the fire breaks out in a subway, a kindergarten, a school, a dormitory, a tunnel, etc. the face protector according to the present invention can considerably reduce a loss of lives.

FIGS. 8 to 13 experimental data and graphs showing a performance of the cloth member of the portable face protector according to the present invention.

FIG. 8 is a test certificate from the Korea Institute of Construction Technology, and FIG. 9 is a document describing an apparatus and method for testing the wet cloth member. The test conditions of the cloth member and the testing apparatus and method are described in FIG. 9. Therefore, the description thereof will be omitted.

Figure 10:
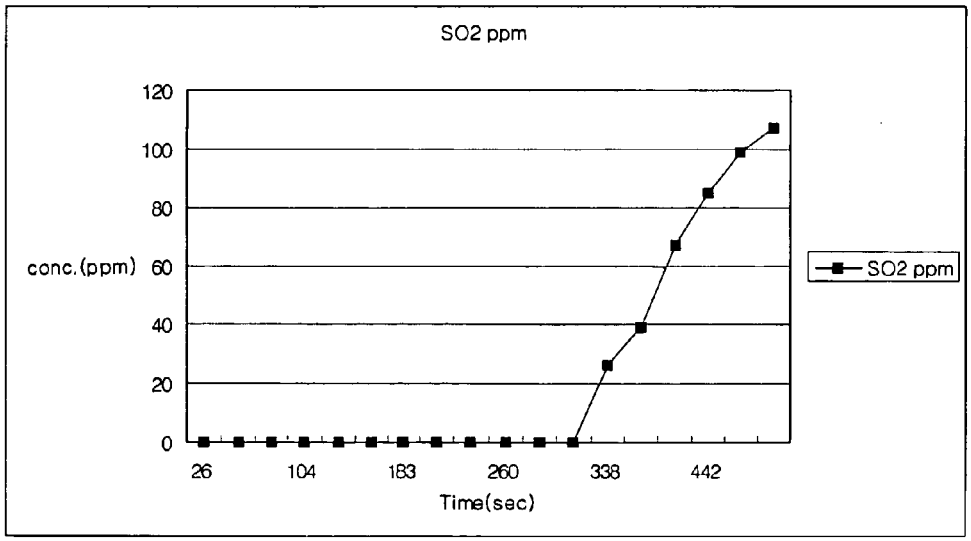
Figure 11:
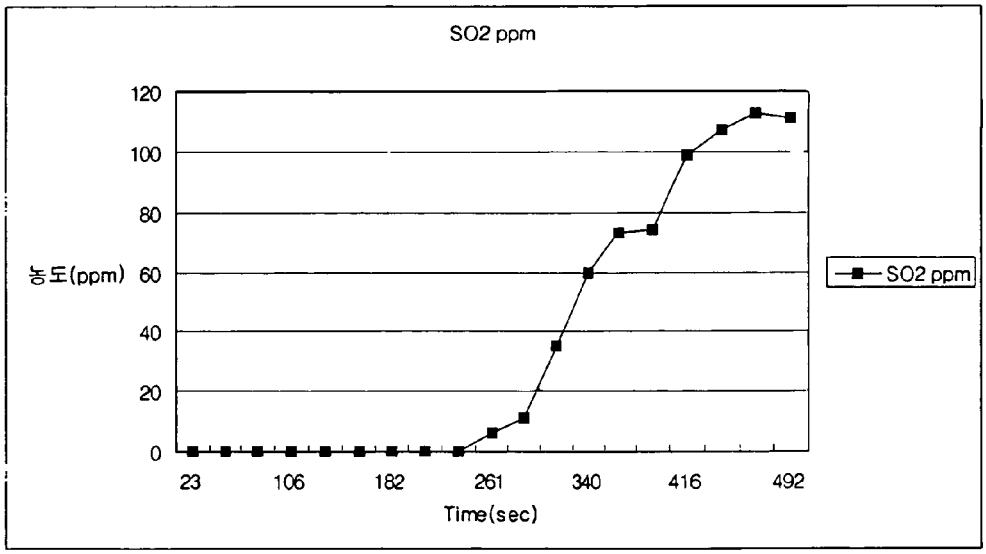

FIGS. 10 and 11 are an experimental data and a graph showing a change-over-time of a concentration of sulfur dioxide passing through the wet cloth member in a case that sulfur dioxide having a basic concentration of 197.2 ppm is passed through the wet cloth member under the test conditions of FIG. 9.

First, as shown in the data and graph of FIG. 10, the concentration of sulfur dioxide passing through the cloth member is '0' for 312 seconds. However, after the time of 312 seconds, the concentration of sulfur dioxide is gradually increased.

In FIG. 11, the concentration of sulfur dioxide passing through the cloth member is '0' for 235 seconds. However, after the time of 235 seconds, the concentration of sulfur dioxide is gradually increased.

As shown in the experimental result of FIGS. 10 and 11, when the user covers his/her mouth and nose with the cloth member and escapes from the critical regions, the user can be protected from the poisonous gas such as the sulfur dioxide for at least 235~312 seconds.

FIGS. 12 and 13 are data showing a change-over-time of a concentration of hydrogen chloride passing through the wet cloth member in a case that hydrogen chloride having a basic concentration of 982 ppm is passed through the wet cloth member under the same test conditions as in FIG. 9.

As shown in FIG. 12, the concentration of hydrogen chloride passing through the cloth member is '0' for 2015 seconds.

Also, in other three test results as shown in FIG. 13, the concentration of hydrogen chloride passing through the cloth member is '0' for 307 seconds in data 11, for 314 seconds in data 12 and for 314 seconds in data 13, respectively.

As shown in FIGS. 12 and 13, the users can be safely protected from the poisonous gas such sulfur dioxide or hydrogen chloride while they escape from the critical region.

Since the face protector according to the present invention is small and light, anyone can conveniently carry the face protector in his/her pocket or handbag.

Further, since the face protector according to the present invention is low-priced, a large quantity of the face protectors can be provided at a public place such as a theater, a school, a subway, etc., at a low price. Thus, many human lives can effectively escape from the critical region in an emergency.

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A portable face protector having multiple portions for coordinated use carried in a common container, comprising:

a first portion including a visibility securing member having a transparent window portion and an attaching portion formed contiguously around the transparent window portion such that the attaching portion may tightly cover a face around eyes of a user in an airtight manner, the visibility securing member being dry sealed prior to use in a disposable first receiving portion; and a second portion including a cloth member for covering the face around a mouth and a nose of the user in an airtight manner so as to filter poisonous gas, the cloth member being wet sealed prior to use in isolation from the visibility securing member in a disposable second receiving portion;

wherein, in an emergency, the visibility securing member is air-tightly attached to the face around eyes so as to secure visibility of the user through the transparent window portion, and the cloth member is held by a hand of the user so as to tightly cover the face around the mouth and the nose, whereby the user can be protected from the poisonous gas and can safely escape from a critical region.

2. The protector as claimed in claim 1, wherein the attaching portion of the visibility securing member has an adhesive surface that is covered with a protecting paper to prevent the adhesive surface from being exposed to an outside.

3. The protector as claimed in claim 2, wherein the protecting paper has a separating portion at a side thereof so as to be facilely separated from the adhesive surface of the attaching portion.

4. The protector as claimed in claim 1, wherein the cloth member is formed of antibiotic cotton paper.

5. The protector as claimed in claim 1, wherein the cloth member is formed of a fabric material.

6. The protector as claimed in any one of claims 1, 4 and 5, wherein the cloth member is vacuously packed in a state of being wet with a solution for filtering the poisonous gas.

7. The protector as claimed in any one of claims 1, 4 and 5, wherein the cloth member has an active carbon portion for filter the poisonous gas.

8. The apparatus as claimed in claim 1, wherein the visibility securing member is vacuously packed prior to use in the first receiving portion, and cloth member is vacuously packed prior to use in the second receiving portion.

9. The protector as claimed in claim 8, wherein the first and second receiving portions are formed of vinyl or aluminum foil.

10. The protector as claimed in claim 8, wherein the first and second receiving portions are respectively formed with a detaching groove at a side thereof so as to rapidly and easily rip one side of each of the first and second receiving portions open and then withdraw the visibility securing member and the cloth member.

11. The protector as claimed in claim 1, wherein the cloth member is vacuously packed in a wet state with a solution for filtering the poisonous gas; and, wherein the solution is saline solution or purified water.

12. The protector as claimed in claim 4, wherein the cloth member is vacuously packed in a wet state with a solution for filtering the poisonous gas; and, wherein the solution is saline solution or purified water.

13. The protector as claimed in claim 5, wherein the cloth member is vacuously packed in a wet state with a solution for filtering the poisonous gas; and, wherein the solution is saline solution or purified water.

* * * * *